US007897556B2

(12) United States Patent
Assmann et al.

(10) Patent No.: US 7,897,556 B2
(45) Date of Patent: Mar. 1, 2011

(54) PHTHALIMIDOPEROXYHEXANOIC ACID PARTICLES ENCAPSULATED IN A WATER SOLUBLE MATERIAL

(75) Inventors: Georg Assmann, Jüchen (DE); Horst-Dieter Speckmann, Langenfeld (DE); Frank Meier, Düsseldorf (DE); Helga Werner, Rommerskirchen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 240 days.

(21) Appl. No.: 11/542,810

(22) Filed: Oct. 4, 2006

(65) Prior Publication Data

US 2007/0093402 A1 Apr. 26, 2007

Related U.S. Application Data

(63) Continuation of application No. PCT/EP2005/003699, filed on Apr. 8, 2005.

(30) Foreign Application Priority Data

Apr. 15, 2004 (DE) ..... 10 2004 018 790

(51) Int. Cl.
*C11D 3/395* (2006.01)
*C11D 3/37* (2006.01)

(52) U.S. Cl. ..... 510/349; 510/276; 510/309; 510/302; 510/367; 510/372; 510/375; 510/438; 510/441; 510/442

(58) Field of Classification Search ..... 510/276, 510/302, 309, 349, 367, 372, 375, 438, 441, 510/442

See application file for complete search history.

(56) References Cited

U.S. PATENT DOCUMENTS

| | | | | | |
|---|---|---|---|---|---|
| 3,158,615 | A | | 11/1964 | Dunn et al. | |
| 3,770,816 | A | | 11/1973 | Nielsen | |
| 3,908,045 | A | * | 9/1975 | Alterman et al. | 427/213 |
| 4,225,451 | A | | 9/1980 | McCrudden | |
| 4,457,858 | A | | 7/1984 | Saran et al. | |
| 4,524,009 | A | | 6/1985 | Valenty | |
| 4,639,325 | A | | 1/1987 | Valenty et al. | |
| 4,707,307 | A | * | 11/1987 | Hutton et al. | 562/2 |
| 4,816,553 | A | | 3/1989 | Baur et al. | |
| 4,820,439 | A | | 4/1989 | Rieck | |
| 4,985,553 | A | | 1/1991 | Fuertes et al. | |
| 5,096,781 | A | | 3/1992 | Vieira et al. | |
| 5,246,620 | A | | 9/1993 | Gethoffer et al. | |
| 5,356,607 | A | | 10/1994 | Just | |
| 5,434,069 | A | * | 7/1995 | Tsaur et al. | 510/530 |
| 5,494,488 | A | | 2/1996 | Arnoldi et al. | |
| 5,501,814 | A | | 3/1996 | Engelskirchen et al. | |
| 5,541,316 | A | | 7/1996 | Engelskirchen et al. | |
| 5,589,370 | A | | 12/1996 | Ratuiste et al. | |
| 5,747,441 | A | * | 5/1998 | Domburg et al. | 510/375 |
| 5,780,420 | A | | 7/1998 | Breuer et al. | |
| 5,821,360 | A | | 10/1998 | Engelskirchen et al. | |
| 5,830,956 | A | | 11/1998 | Stockhausen et al. | |
| 5,854,321 | A | | 12/1998 | Krause et al. | |
| 5,922,670 | A | | 7/1999 | Knuebel et al. | |
| 5,959,101 | A | | 9/1999 | Engelskirchen et al. | |
| 6,187,055 | B1 | | 2/2001 | Kottwitz et al. | |
| 6,656,898 | B1 | * | 12/2003 | Foley et al. | 510/393 |
| 7,375,070 | B2 | * | 5/2008 | Pegelow et al. | 510/296 |
| 2002/0010123 | A1 | * | 1/2002 | Schmiedel et al. | 510/446 |
| 2002/0103095 | A1 | * | 8/2002 | Becker et al. | 510/305 |
| 2003/0139318 | A1 | * | 7/2003 | Pfeiffer et al. | 510/439 |
| 2004/0147427 | A1 | * | 7/2004 | Waits et al. | 510/521 |
| 2004/0186039 | A1 | * | 9/2004 | Sunder et al. | 510/446 |
| 2006/0049077 | A1 | * | 3/2006 | Fregonese et al. | 206/524.7 |
| 2006/0116309 | A1 | * | 6/2006 | Lambotte et al. | 510/302 |
| 2006/0205628 | A1 | * | 9/2006 | Deinhammer et al. | 510/386 |
| 2008/0064623 | A1 | * | 3/2008 | Sunder et al. | 510/443 |
| 2008/0312123 | A1 | * | 12/2008 | Weber et al. | 510/451 |

FOREIGN PATENT DOCUMENTS

| | | |
|---|---|---|
| CA | 2053900 | 10/1990 |
| DE | 3128336 | 1/1983 |
| DE | 4012769 | 10/1991 |
| DE | 19513391 | 10/1991 |
| DE | 4221381 | 2/1994 |
| DE | 4300772 | 7/1994 |
| DE | 4303320 | 8/1994 |
| DE | 4321022 | 1/1995 |
| DE | 4400024 | 6/1995 |
| DE | 4417734 | 11/1995 |
| DE | 19540086 | 4/1997 |
| DE | 19600018 | 10/1997 |
| EP | 0074730 | 3/1983 |
| EP | 0150930 | 8/1985 |
| EP | 0164514 | 12/1985 |
| EP | 0232202 | 8/1987 |
| EP | 0280223 | 8/1988 |
| EP | 0374751 | 6/1990 |

(Continued)

OTHER PUBLICATIONS

DIN 53900, Jul. 1972. Schulze, "Fettalkoholoxathylatacetate", Seifen, Öle, Fette, Wachse 101, Feb. 1975, p. 37-44.

Stroink, "Eigenschaften und Anwendungsmoglichkeiten von Ethercarbonsauren in Wasch- und Reinigungsmitteln", Seifen Öle, Fette, Wachse 115, Apr. 1989, p. 235-240.

Holzbauer and Herbst, "n-Octyl-polyoxypropylen-carboxymethylate" Tenside Surfactants Detergents. 25, 308 (1988).

Reinhart, G., "Imidoperoxicarbonsäuren als potentielle Bleichmittel Für die Waschmittelindusstrie", SOFW-Journal, 120 Jahrgang 411-416 (Jul. 1994).

5th World Surfactants Congress CESIO 2000 Proceedings, Reinhart, Gerd, "Nitrogent-containing preformed peracids: Potential bleaching agents for use in liquid detergents?", vol. 2, 2002.

(Continued)

*Primary Examiner* — Charles I Boyer

(74) *Attorney, Agent, or Firm* — David P. LeCroy

(57) ABSTRACT

The invention relates to encapsulated bleaching agent particles. Said particles consist of a core that contains a bleaching-agent active ingredient and a coating of water-soluble material that at least partially surrounds said core, the core containing peroxocarboxylic acid and the coating material containing polyvinyl alcohol. The particles can be produced by introducing a particulate peroxocarboxylic acid into a fluidized bed, by spraying an aqueous solution containing polyvinyl alcohol onto said bed and by subsequent drying or spray drying.

8 Claims, No Drawings

FOREIGN PATENT DOCUMENTS

| | | | |
|---|---|---|---|
| EP | 0427349 | | 11/1990 |
| EP | 0472042 | | 2/1992 |
| EP | 0510761 | | 10/1992 |
| EP | 0542496 | | 5/1993 |
| EP | 0653485 | | 5/1995 |
| EP | 0659877 | | 6/1995 |
| EP | 0703292 | | 9/1995 |
| EP | 0682145 | | 11/1995 |
| EP | 0727448 | | 8/1996 |
| EP | 0728749 | | 8/1996 |
| EP | 0825188 | | 2/1998 |
| EP | 653485 | * | 5/2000 |
| EP | 0852259 | | 9/2002 |
| JP | 58217598 | | 12/1983 |
| JP | 9339896 | | 12/1993 |
| WO | WO9013533 | | 11/1990 |
| WO | WO9108171 | | 6/1991 |
| WO | WO9218542 | | 10/1992 |
| WO | WO9308251 | | 4/1993 |
| WO | WO9316110 | | 8/1993 |
| WO | WO9428030 | | 12/1994 |
| WO | WO9507303 | | 3/1995 |
| WO | WO9512619 | | 5/1995 |
| WO | WO9519953 | | 7/1995 |
| WO | WO9519954 | | 7/1995 |
| WO | WO9519955 | | 7/1995 |
| WO | WO9520029 | | 7/1995 |
| WO | WO9520608 | | 8/1995 |
| WO | WO9623768 | | 8/1996 |
| WO | 99/07817 | * | 2/1999 |
| WO | WO9907817 | | 2/1999 |
| WO | 00/17309 | * | 3/2000 |
| WO | 0017309 | | 3/2000 |

OTHER PUBLICATIONS

Rohm and Haas ACRYSOL ASE-60 Technical Data Sheet, Aug. 2003.

* cited by examiner

PHTHALIMIDOPEROXYHEXANOIC ACID PARTICLES ENCAPSULATED IN A WATER SOLUBLE MATERIAL

CROSS-REFERENCE TO RELATED APPLICATIONS

This application is a continuation under 35 U.S.C. §365(c) and 35 U.S.C. §120 of International Application PCT/EP2005/003699, filed Apr. 8, 2005, which is incorporated herein by reference in its entirety. This application also claims priority under 35 U.S.C. §119 of German Application DE 10 2004 018 790.8, filed Apr. 15, 2004. Both the International Application and the German Application are incorporated by reference herein in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present patent application relates to water-soluble, encapsulated peroxycarboxylic acid particles, processes for their manufacture, and their use, particularly in liquid detergents or cleansing agents.

In liquid detergents and cleansing agents, particularly when they are in liquid form and/or comprise large amounts of water, there may result a decrease in their activity and thereby a decrease in the overall washing performance of the composition because of interactions between the individual ingredients due to chemical incompatibility, even when the composition is stored for a relatively short time. In principle, this decrease in activity concerns all detergent ingredients that in the washing process undergo chemical reactions that contribute to the washing performance, particularly bleaching agents and enzymes, although tensidic or chelating ingredients that are responsible for dissolution processes or complexation steps, are not completely storage stable in liquid, particularly aqueous systems, particularly in the presence of the cited chemically reactive ingredients.

On various occasions, it has been proposed to solve this problem by not simultaneously incorporating all ingredients required for a good washing or cleaning result into a liquid composition, but rather by supplying the consumer with several components that have to be mixed together shortly before, or during the washing or cleaning process and which each only comprise ingredients that are compatible with each other and first come into contact together during the course of the application. The combined dosing of several components, in comparison with dosing only a single composition, is often felt by the consumer as being too laborious.

Imidoperoxycarboxylic acids are known bleach ingredients in detergents and cleansing agents. However, their poor storage stability is problematic, especially in liquid formulations and at higher pH values. Proposals have already been made in the prior art to solve this problem.

(2) Description of Related Art, Including Information Disclosed Under 37 C.F.R. §§1.97 and 1.98.11.

In European Patent Application EP 0 510 761 A1, particles of 6-phthalimidoperoxyhexanoic acid are described, which are encapsulated with a layer of wax with a melting point in the range 40° C. to 50° C. The bleaching agent can therefore only be released from these particles at temperatures above the melting point of the wax.

European patent application EP 0 653 485 discloses capsule compositions, in the interior of which, 6-phthalimidoperoxyhexanoic acid is present as a dispersion in oil. The manufacture of these capsules therefore requires a prior emulsification process to manufacture the peracid dispersion.

The result of the measures described in the prior art for stabilizing bleaching agents, particularly in liquid compositions, is not always sufficient. For long storage times, the bleaching agent has been observed to decompose—in spite of the presence of the cited stabilizers—with a consequent loss in bleach activity and thus in washing power.

BRIEF SUMMARY OF THE INVENTION

There was therefore a need to make available easily manufacturable peroxycarboxylic acid particles that are storage stable, i.e. that suffer the least possible loss in activity even when they are stored for a long time, in particular, as components of a detergent or cleansing agent. Among the conditions of use of such a composition, in addition, the bleaching agent should be sufficiently rapidly released so as to obtain good bleaching properties, particularly for fabrics, but also on hard surfaces.

The subject matter of the present invention to redress this is an encapsulated bleaching agent particle, consisting of a core that comprises active bleaching agent and a coating of water-soluble material that at least partially surrounds this core, wherein the particle is characterized in that the core comprises peroxycarboxylic acid and the coating material comprises polyvinyl alcohol.

BRIEF DESCRIPTION OF THE SEVERAL VIEWS OF THE DRAWING(S)

Not Applicable

DETAILED DESCRIPTION OF THE INVENTION

The term "water-soluble" is understood to mean that the material described in this way dissolves to at least 3 g/l, particularly at least 6 g/l in water at pH 7 at room temperature without leaving a residue. Preferably, a water-soluble material is soluble under the normal washing or cleaning conditions at the concentration which results from the added amount of the particles encapsulated with it in the finished detergent or cleansing agent without leaving a residue.

According to manufacturing processes for the particles, which are described below, the coating material can comprise solvents, particularly water, in amounts optionally up to 10 wt. %, preferably 0.1 to 5 wt. % and particularly preferably below 4 wt. %, each based on the encapsulated particles. The amounts of coating materials referred to below do not take into account any eventual solvent content.

According to the invention, the peroxycarboxylic acid, present in the core of the encapsulated particles, which can also be called organic peracid, may carry aliphatic and/or cyclic, there under heterocyclic and/or aromatic groups. They include, for example, peroxyformic acid, peroxyacetic acid, peroxypropionic acid, peroxyhexanoic acid, peroxybenzoic acid and its substituted derivatives such as m-chloroperoxybenzoic acid, the mono- or di-peroxyphthalic acids, 1,12-diperoxydodecanedioic acid, nonylamidoperoxyadipic acid, 6-hydroxyperoxyhexanoic acid, 4-phthalimidoperoxybutanoic acid, 5-phthalimidoperoxypentanoic acid, 6-phthalimidoperoxyhexanoic acid, 7-phthalimidoperoxyheptanoic acid, N,N'-terephthaloyl-di-6-aminoperoxyhexanoic acid and their mixtures. For the case that the peroxycarboxylic acid is not in solid form at room temperature, it can be converted into particulate form by the known method of adding inert carrier materials prior to the encapsulation with the water-soluble material; however, a room temperature solid peroxycarboxylic acid is preferably used. The preferred peracids include 6-phthalimidoperoxyhexanoic acid. In the inventive particles, the peroxycarboxylic acid content is preferably 20 wt. % to 90 wt. %, particularly 40 wt. % to 80 wt. % and particularly preferably 50% to 70 wt. %.

Polyvinyl alcohol is the essential, and in an embodiment of the invention, apart from optional water, the sole ingredient of the coating material. Polyvinyl alcohols cannot be obtained by direct polymerization methods, as the required monomer vinyl alcohol does not exist. Polyvinyl alcohols are therefore manufactured using polymer-analogous reactions by hydrolysis, industrially however especially by alkaline catalyzed transesterification of polyvinyl acetates with alcohols (preferably methanol) in solution. Typical commercial polyvinyl alcohols, which are offered as yellowish white powders or granules having degrees of polymerization in the range of approximately 500 to 2,500 (corresponding to molecular weights of approximately 20,000 to 100,000 g/mol), have various degrees of hydrolysis of 98-99 wt. % or 87-89 molar %. They are therefore partially hydrolyzed polyvinyl acetates with a ca. 1-2 wt. % or 11-13 mol % residual content of acetyl groups. The manufacturers characterize the polyvinyl alcohols by stating the degree of polymerization of the initial polymer, the degree of hydrolysis, the saponification number and/or the solution viscosity. Conversion temperatures of the polyvinyl alcohols depend on the content of acetyl groups, the distribution of the acetyl groups along the chain and the tacticity of the polymers. Fully hydrolyzed polyvinyl alcohols have a glass transition temperature of 85° and a melting point of 228°. The corresponding values for partially hydrolyzed products are significantly lower at approximately 58° and 186°. The solubility in water and in a few strongly polar organic solvents (formamide, dimethylformamide, dimethyl sulfoxide) of polyvinyl alcohols is a function of the degree of hydrolysis; they are not attacked by (chlorinated) hydrocarbons, esters, fats or oils and normally have a density of about 1.2-1.3 g/cm$^3$. Polyvinyl alcohols are classified as toxicologically inoffensive and are at least partially biologically degradable. Preferably, polyvinyl alcohols are employed that have a degree of hydrolysis in the range 20 to 350, particularly in the range 100 to 300 and particularly preferably 150 and 250. The degree of polymerization is preferably in the range 100 to 3,000, particularly 150 to 2,000 and particularly preferably 250 to 500.

Optionally comprised additional coating materials for the peroxycarboxylic acids must exhibit the cited water solubility and be capable of being deposited as melts or as a solution in water or in another volatile solvent onto the peroxycarboxylic acid in the devices normally used for encapsulating particles, for example, granulators or fluidized beds.

The additional coating material includes, for example, the nonionic surfactants, mineral acids, carboxylic acids and/or organic polymers cited below. Polymeric polycarboxylates, particularly polymerization products of acrylic acid, methacrylic acid or maleic acid or copolymers of at least two of these, which are also in completely or at least partially neutralized form, particularly in the form of the alkali metal salts, may be employed. Exemplary, commercially available products are Sokolan® CP 5, CP 10 and PA 30 from BASF.

As an alternative or in addition to polymeric polycarboxylate, phosphonic acids or optionally functionally modified phosphonic acids, for example, hydroxy- or aminoalkane phosphonic acids and/or their alkali metal salts may also be employed. Examples of the phosphonic acids include 1-hydroxyethane-1,1-diphosphonic acid (HEDP) or the dialkali metal salt of this acid, ethylenediamine tetramethylene phosphonic acid (EDTMP), diethylenetriamine pentamethylene phosphonic acid (DTPMP) and their higher homologs. In the cited alkali metal salts and also in other places of the present text, sodium is the preferred alkali metal.

Alternatively or additionally, the coating material can also comprise other acids, for example, mineral acids such as phosphoric acid, sulfuric acid and/or hydrochloric acid, and/or carboxylic acids such as adipic acid, ascorbic acid, citric acid and/or $C_{10}$ to $C_8$ fatty acids, thereby further increasing the stability of the peroxycarboxylic acid. Whereas the cited mineral acids essentially serve to adjust the pH of the coating material typically deposited as an aqueous preparation, and hence are only present in small amounts of normally maximum 0.5 wt. %, preferably not more than 0.1 wt. % in the inventively encapsulated particles, the phosphonic acids can be present in the inventively encapsulated particles in higher quantities of, for example, up to 10 wt. %, preferably not more than 5 wt. %, and the carboxylic acids in even higher quantities of, for example, up to 35%, preferably not more than 25 wt. %.

Also, anionically or nonionically modified celluloses with ether bonds, particularly alkali carboxymethyl cellulose, methyl cellulose, methyl hydroxyethyl cellulose or methyl hydroxypropyl cellulose, alone or in mixtures, or the corresponding starch derivatives can be employed as additional components of the coating material.

In a preferred embodiment of the invention, the coating material is selected from the combinations of polyvinyl alcohol with acids, alkyl cellulose ethers, hydroxyalkyl cellulose ethers, alkyl hydroxyalkyl cellulose ethers and their mixtures. Combinations of polyvinyl alcohol with acids, in which the weight ratio of polyvinyl alcohol to acid is in the range 1,000:1 to 1:2, particularly 500:1 to 1:1, are particularly preferred.

The coating material is preferably deposited in such amounts on the particulate peroxycarboxylic acid that the encapsulated peroxycarboxylic acid particles consist of 5 wt. % to 50 wt. % of the coating material. The diameters of the encapsulated peroxycarboxylic acid particles are preferably in the range 100 μm to 2,000 μm, particularly in the range of 100 μm to 800 μm or in the range 800 μm to 1,600 μm; the starting material is therefore a suitably more finely divided peroxycarboxylic acid material, covered with the encapsulating material. Preferably, the process involves spraying a fluidized bed of the peroxycarboxylic acid particles to be encapsulated, with a solvent-containing preparation, preferably an aqueous preparation, of the coating material, then or subsequently a drying step is carried out, wherein the solvent, preferably water, is at least partially removed by evaporation and the encapsulated peroxycarboxylic acid particles are discharged from the fluidized bed in principle in the normal way.

Accordingly, a further subject matter of the invention is a process for manufacturing encapsulated bleaching agent particles, consisting of a core that comprises active bleaching agent and a coating of water-soluble material that at least partially surrounds this core, by the introduction of a particulate peroxycarboxylic acid into a fluidized bed, spraying on an aqueous solution that comprises polyvinyl alcohol, and drying. Preferably, during the spraying of the aqueous solution and during the drying, the temperature of the bleaching agent particles does not exceed 50° C., particularly 35° C. In particular, this can be achieved by selecting not too high a temperature for the fluidized bed, for example, lower than 65° C.

Alternatively, an inventive encapsulated peroxycarboxylic acid particle can also be manufactured by spray drying. Accordingly, a further subject matter of the invention is a process for manufacturing encapsulated bleaching agent particles, consisting of a core that comprises active bleaching agent and a coating of water-soluble material that at least partially surrounds this core, by spray drying an aqueous preparation that comprises peroxycarboxylic acid and polyvinyl alcohol.

Particularly with this method, it is obvious that the coating material must be present not only as the external sheath, but additionally, can also be a component of the peroxycarboxylic acid-containing core. Accordingly, a further embodiment of the invention relates to an inventively encapsulated particle, in which the core comprises carrier material in addition to the peroxycarboxylic acid, said carrier material being identical to the coating material. Preferably, the portion of the sum of coating material and carrier material makes up 5 wt. % to 50 wt. % of the encapsulated particle.

An inventive composition or a composition manufactured according to the inventive process is preferably used for manufacturing detergents or cleansing agents. A direct contact of the alkaline components usually comprised in the coating with the acidic bleaching agent is avoided by means of the coating. The coating can govern the ingress of water to the bleaching agent components. The dissolution of the bleaching agent active ingredient can be controlled in a simple manner by the choice of the coating material and the thickness of the layer, i.e. the relative amounts of deposited coating material.

Besides the encapsulated peroxycarboxylic acid particles, such a detergent or cleansing agent can comprise any of the ingredients customarily found in such compositions, such as, for example, surfactants, solvents, builders, enzymes and additional auxiliaries such as soil repellents, thickeners, colorants and fragrances or the like. It can be present either in solid form or also as a liquid, wherein in the latter case it is preferably anhydrous. Here, the term "anhydrous" is understood to mean a composition that comprises no more than 10 wt. %, particularly not more than 5 wt. % water.

In a preferred embodiment, it comprises nonionic surfactants and/or organic solvents and optionally anionic surfactants, cationic surfactants and/or amphoteric surfactants. It is further preferred that the solvents or solvent mixtures used in the liquid phase of the composition are surfactants or comprise at least a fraction of surfactants that corresponds to particularly 10 wt. % to 99 wt. % of the total solvent.

Preferably, surfactants of the sulfonate type, alk(en)yl sulfonates, alkoxylated alk(en)yl sulfates, ester sulfonates and/or soaps are used as the anionic surfactants.

Suitable surfactants of the sulfonate type are advantageously $C_{9-13}$ alkylbenzene sulfonates, olefin sulfonates, i.e. mixtures of alkene- and hydroxyalkane sulfonates, and disulfonates, as are obtained, for example, by the sulfonation with gaseous sulfur trioxide of $C_{12-18}$ monoolefins having a terminal or internal double bond and subsequent alkaline or acidic hydrolysis of the sulfonation products.

Preferred alk(en)yl sulfates are the alkali and especially the sodium salts of the sulfuric acid half-esters of the $C_{10}$-$C_{18}$ fatty alcohols, for example, from coconut butter alcohol, tallow alcohol, lauryl, myristyl, cetyl or stearyl alcohol or from $C_8$-$C_{20}$ oxo alcohols and those half-esters of secondary alcohols of these chain lengths. Alk(en)yl sulfates of the cited chain lengths that comprise a synthetic straight chain alkyl group manufactured petrochemically are also preferred. The $C_{12}$-$C_{16}$ alkyl sulfates and $C_{12}$-$C_{15}$ alkyl sulfates as well as $C_{14}$-$C_{15}$ alkyl sulfates and $C_{14}$-$C_{16}$ alkyl sulfates are particularly preferred on the grounds of laundry performance. The 2,3-alkyl sulfates, which are manufactured according to the U.S. Pat. No. 3,234,258 or 5,075,041, and which can be obtained from Shell Oil Company under the trade name DAN®, are also suitable anionic surfactants.

Sulfuric acid mono-esters derived from straight-chained or branched $C_{7-21}$ alcohols ethoxylated with 1 to 6 moles ethylene oxide are also suitable, such as 2-methyl-branched $C_{9-11}$ alcohols with an average of 3.5 mol ethylene oxide (EO) or $C_{12-18}$ fatty alcohols with 1 to 4 EO. Due to their high foaming performance, they are only used in relatively small quantities in detergents, for example, in amounts of 0 to 5% by weight.

The esters of α-sulfofatty acids (ester sulfonates), e.g., the α-sulfonated methyl esters of hydrogenated coco-, palm nut- or tallow acids are likewise suitable.

Soaps in particular, can be considered as further anionic surfactants. Saturated fatty acid soaps are particularly suitable, such as the salts of lauric acid, myristic acid, palmitic acid, stearic acid, hydrogenated erucic acid and behenic acid, and especially soap mixtures derived from natural fatty acids such as coconut oil fatty acid, palm kernel oil fatty acid or tallow fatty acid. Those soap mixtures are particularly preferred that are composed of 50 to 100 wt. % of saturated $C_{12}$-$C_{24}$ fatty acid soaps and 0 to 50 wt. % of oleic acid soap.

A further class of anionic surfactants is that of the ether carboxylic acids, obtainable by treating fatty alcohol ethoxylates with sodium chloroacetate in the presence of basic catalysts. They have the general formula: $RO—(CH_2—CH_2—O)_p—CH_2—COOH$ with $R=C_1$-$C_{18}$ and p=0.1 to 20. Ether carboxylic acids are insensitive to water hardness and possess excellent surfactant properties. The manufacture and application are, for example, described in Seifen, Öle, Fette, Wachse 101, 37 (1975); 115, 235 (1989) and Tenside Deterg. 25, 308 (1988).

Cationically active surfactants comprise the hydrophobic high molecular group required for the surface activity in the cation by dissociation in aqueous solution. The most important representatives of the cationic surfactants are the quaternary ammonium compounds of the general formula: $(R^1R^2R^3R^4N^+)\,X^-$. Here $R_1$ stands for $C_1$-$C_8$ alk(en)yl, $R^2$ to $R^4$, independently of each other, for $C_nH_{2n+1-p-x}(Y^1(CO)R^5)_P—(Y^2H)_x$, wherein n stands for whole numbers except 0 and p and x stand for whole numbers or 0. $Y^1$ and $y^2$ stand, independently of one another, for O, N or NH. $R^5$ designates a $C_3$-$C_{23}$ alk(en)yl chain. X is a counter ion, preferably selected from the group of the halides, alkyl sulfates and alkyl carbonates. Cationic surfactants, in which the nitrogen group is substituted with two long acyl groups and two short alk(en)yl groups, are particularly preferred.

Amphoteric or ampholytic surfactants possess a plurality of functional groups that can ionize in aqueous solution and thereby—depending on the conditions of the medium—lend anionic or cationic character to the compounds (see DIN 53900, July 1972). Close to the isoelectric point (around pH 4), the amphoteric surfactants form inner salts, thus becoming poorly soluble or insoluble in water. Amphoteric surfactants are subdivided into ampholytes and betaines, the latter existing as zwitterions in solution. Ampholytes are amphoteric electrolytes, i.e. compounds that possess both acidic as well as basic hydrophilic groups and therefore behave as acids or as bases depending on the conditions. Compounds with the atomic grouping $R_3N^+$—$CH_2$—COO–, which show typical properties of zwitterions, are designated as betaines.

The added nonionic surfactants are preferably alkoxylated and/or propoxylated, particularly primary alcohols having preferably 8 to 18 carbon atoms and an average of 1 to 12 mol ethylene oxide (EO) and/or 1 to 10 mol propylene oxide (PO) per mol alcohol. $C_8$-$C_{16}$ Alcohol alkoxylates, advantageously ethoxylated and/or propoxylated $C_{10}$-$C_{15}$ alcohol alkoxylates, particularly $C_{12}$-$C_{14}$ alcohol alkoxylates, with an ethoxylation degree between 2 and 10, preferably between 3 and 8, and/or a propoxylation degree between 1 and 6, preferably between 1.5 and 5, are particularly preferred. The cited degrees of ethoxylation and propoxylation constitute statistical average values that can be a whole or a fractional number for a specific product. Preferred alcohol ethoxylates and propoxylates have a narrowed homolog distribution (narrow range ethoxylates/propoxylates, NRE/NRP). In addition to these nonionic surfactants, fatty alcohols with more than 12 EO can also be used. Examples of these are (tallow) fatty alcohols with 14 EO, 16 EO, 20 EO, 25 EO, 30 EO or 40 EO.

Furthermore, as additional nonionic surfactants, alkyl glycosides that satisfy the general Formula $RO(G)_x$, can be added, e.g., as compounds, particularly with anionic surfactants, in which R means a primary linear or methyl-branched, particularly 2-methyl-branched, aliphatic group containing 8 to 22, preferably 12 to 18 carbon atoms and G stands for a glycose unit containing 5 or 6 carbon atoms, preferably for glucose. The degree of oligomerization x, which defines the distribution of monoglycosides and oligoglycosides, is any number between 1 and 10, preferably between 1.1 and 1.4.

Another class of preferred nonionic surfactants, which are used either as the sole nonionic surfactant or in combination with other nonionic surfactants, in particular, together with alkoxylated fatty alcohols and/or alkyl glycosides, are alkoxylated, preferably ethoxylated or ethoxylated and propoxylated fatty acid alkyl esters preferably containing 1 to 4 carbon atoms in the alkyl chain, more particularly the fatty acid methyl esters which are described, for example, in Japanese Patent Application JP-A-58/217 598 or which are preferably produced by the process described in International Patent Application WO-A-90/13533. Methyl esters of $C_{12}$-$C_{18}$ fatty acids containing an average of 3 to 15 EO, particularly containing an average of 5 to 12 EO, are particularly preferred.

Nonionic surfactants of the amine oxide type, for example, N-coco alkyl-N,N-dimethylamine oxide and N-tallow alkyl-N,N-dihydroxyethylamine oxide, and the fatty acid alkanolamides may also be suitable. The quantity in which these nonionic surfactants are used is preferably no more than the quantity in which the ethoxylated fatty alcohols are used and, particularly no more than half that quantity.

The so-called gemini surfactants can be considered as further surfactants. Generally speaking, such compounds are understood to mean compounds that have two hydrophilic groups and two hydrophobic groups per molecule. As a rule, these groups are separated from one another by a "spacer." The spacer is usually a hydrocarbon chain that is intended to be long enough such that the hydrophilic groups are a sufficient distance apart to be able to act independently of one another. These types of surfactants are generally characterized by an unusually low critical micelle concentration and the ability to strongly reduce the surface tension of water. In exceptional cases, however, not only dimeric but also trimeric surfactants are meant by the term gemini surfactants.

Suitable gemini surfactants are, for example, sulfated hydroxy mixed ethers according to German Patent Application DE-A-43 21 022 or dimer alcohol bis- and trimer alcohol tris sulfates and ether sulfates according to International Patent Application WO-A-96/23768. Blocked end group dimeric and trimeric mixed ethers according to German Patent Application DE-A-195 13 391 are especially characterized by their bifunctionality and multifunctionality. Thus, the cited blocked end group surfactants possess good wetting properties and are therefore poor foamers, such that they are particularly suited for use in automatic washing or cleaning processes.

However, gemini polyhydroxyfatty acid amides or polyhydroxyfatty acid amides, such as those described in International Patent Applications WO-A-95/19953, WO-A-95/19954 and WO95-A-/19955 can also be used.

The amount of surfactant comprised in the inventive compositions is advantageously 0.1 wt. % to 90 wt. %, particularly 10 wt. % to 80 wt. % and particularly preferably 20 wt. % to 70 wt. %.

These types of surfactants can make up the total liquid fraction of the inventive composition, but can be totally or partially replaced or supplemented by other organic solvents that are preferably miscible with water. In the last case, room temperature solid representatives of the cited surfactants may be used in such amounts that still yield a liquid composition.

Polydiols, ethers, alcohols, ketones, amides and/or esters are preferably used as the organic solvent for this in amounts of 0 to 90 wt. %, preferably 0.1 to 70 wt. %, particularly 0.1 to 60 wt. %. Low molecular weight polar substances, such as, for example, methanol, ethanol, propylene carbonate, acetone, acetonylacetone, diacetone alcohol, ethyl acetate, 2-propanol, ethylene glycol, propylene glycol, glycerin, diethylene glycol, dipropylene glycol monomethyl ether and dimethylformamide or their mixtures are preferred.

Suitable enzymes include, in particular, those from the classes of hydrolases, such as proteases, esterases, lipases or lipolytic enzymes, amylases, cellulases or other glycosyl hydrolases and mixtures thereof. In the wash, all these hydrolases contribute to removing stains such as protein, fat or starchy stains and against graying. Moreover, cellulases and other glycosyl hydrolases can contribute to increased softness of the textile and to color retention by removing pilling and micro fibrils. Oxidoreductases can also be added to the bleaches or to inhibit the color transfer.

Enzymatic active materials obtained from bacterial sources or fungi such as *bacillus subtilis, bacillus licheniformis, streptomyceus griseus* and *humicola insolens* are particularly well suited. Proteases of the subtilisin type and particularly proteases that are obtained from *bacillus lentus*, are preferably used. Here, mixtures of enzymes are of particular interest, for example, proteases and amylases or proteases and lipases or lipolytic enzymes or proteases and cellulases or cellulases and lipase or lipolytic enzymes or proteases, amylases and lipases or lipolytic enzymes or proteases, lipases or lipolytic enzymes and cellulases, in particular, however proteases and/or lipase-containing mixtures or mixtures with lipolytic enzymes. Examples of such lipolytic enzymes are the known cutinases. Peroxidases or oxidases have also proved to be suitable in certain cases. The suitable amylases particularly include α-amylases, iso-amylases, pullulanases and pectinases. Cellobiohydrolases, endoglucanases and β-glucosidases or mixtures thereof, which are also known as cellobiases are preferred cellulases. As the different cellulase types differ in their CMCase and avicelase activities, the required activities can be adjusted by controlled mixtures of the cellulases.

The content of the enzymes or enzyme mixtures may be, for example, about 0.1 to 5% by weight and is preferably 0.1 to about 3% by weight.

Builders, cobuilders, soil repellents, alkaline salts as well as foam inhibitors, sequestrants, enzyme stabilizers, graying inhibitors, optical brighteners and UV absorbers can be comprised as additional detergent ingredients.

Fine crystalline, synthetic zeolites containing bound water can be used as builders, for example, preferably zeolite A and/or P. Zeolite MAP® (commercial product of the Crosfield company), is particularly preferred as the zeolite P. However, zeolite X and mixtures of A, X, Y and/or P are also suitable. A co-crystallized sodium/potassium aluminum silicate from Zeolite A and Zeolite X, which is available as VEGOBOND AX® (commercial product from Condea Augusta S.p.A.), is also of particular interest. Preferably, the zeolite can be used as a spray-dried powder. For the case where the zeolite is added as a suspension, this can comprise small amounts of nonionic surfactants as stabilizers, for example, 1 to 3 wt. %, based on the zeolite, of ethoxylated $C_{12}$-$C_{18}$ fatty alcohols with 2 to 5 ethylene oxide groups, $C_{12}$-$C_{14}$ fatty alcohols with 4 to 5 ethylene oxide groups or ethoxylated isotridecanols. Suitable zeolites have an average particle size of less than 10 μm (test method: volumetric distribution). Coulter counter) and preferably comprise 18 to 22 wt. %, particularly 20 to 22 wt. % of bound water. Apart from this, phosphates can also be used as builders.

Suitable substitutes or partial substitutes for phosphates and zeolites are crystalline, layered sodium silicates corresponding to the general formula $NaMSi_xO_{2x+1}$. y $H_2O$, wherein M is sodium or hydrogen, x is a number from 1.9 to 4 and y is a number from 0 to 20, preferred values for x being 2, 3 or 4. These types of crystalline layered silicates are described, for example, in European Patent Application EP-A-0 164 514. Preferred crystalline layered silicates of the given formula are those in which M stands for sodium and x assumes the values 2 or 3. Both β- and δ-sodium disilicate $Na_2Si_2O_5y\,H_2O$ are particularly preferred, wherein β-sodium silicate can be obtained, for example, from the process described in International Patent Application WO-A-91/08171.

Preferred builders also include amorphous sodium silicates with a modulus ($Na_2O$:$SiO_2$ ratio) of 1:2 to 1:3.3, preferably 1:2 to 1:2.8 and more preferably 1:2 to 1:2.6, which dissolve with a delay and exhibit multiple wash cycle properties. The delay in dissolution compared with conventional amorphous sodium silicates can have been obtained in various ways, for example, by surface treatment, compounding, compressing/compacting or by over-drying. In the context of this invention, the term "amorphous" also means "X-ray amorphous". In other words, the silicates do not produce any of the sharp X-ray reflexions typical of crystalline substances in X-ray diffraction experiments, but at best one or more maxima of the scattered X-radiation, which have a width of several degrees of the diffraction angle. However, particularly good builder properties may even be achieved where the silicate particles produce indistinct or even sharp diffraction maxima in electron diffraction experiments. This is to be interpreted to mean that the products have microcrystalline regions between 10 and a few hundred nm in size, values of up to at most 50 nm and especially up to at most 20 nm being preferred. This type of X-ray amorphous silicates, which similarly possess a delayed dissolution in comparison with the customary water glasses, are described, for example, in German Patent Application DE-A-44 00 024. Compacted/densified amorphous silicates, compounded amorphous silicates and over dried X-ray-amorphous silicates are particularly preferred.

Naturally, the generally known phosphates can also be added as builders, in so far that their use should not be avoided on ecological grounds. The sodium salts of the orthophosphates, the pyrophosphates and especially the tripolyphosphates are particularly suitable. Their content is generally not more than 25 wt. %, preferably not more than 20 wt. %, each based on the finished composition. In some cases it has been shown that particularly tripolyphosphates, already in low amounts up to maximum 10 wt. %, based on the finished composition, in combination with other builders, lead to a synergistic improvement of the secondary washing power. Preferred amounts of phosphates are under 10 wt. %, particularly 0 wt. %.

Useful organic cobuilders are, for example, the polycarboxylic acids usable in the form of their sodium salts of polycarboxylic acids, wherein polycarboxylic acids are understood to be carboxylic acids that carry more than one acid function. These include, for example, citric acid, adipic acid, succinic acid, glutaric acid, malic acid, tartaric acid, maleic acid, fumaric acid, sugar acids, aminocarboxylic acids, nitrilotriacetic acid (NTA) and its derivatives and mixtures thereof. Preferred salts are the salts of polycarboxylic acids such as citric acid, adipic acid, succinic acid, glutaric acid, tartaric acid, sugar acids and mixtures thereof.

Acids per se can also be used. Besides their building effect, the acids also typically have the property of an acidifying component and, hence also serve to establish a relatively low and mild pH in detergents or cleansing agents. Citric acid, succinic acid, glutaric acid, adipic acid, gluconic acid and any mixtures thereof are particularly mentioned in this regard. Further suitable acidifiers are the known pH regulators such as sodium hydrogen carbonate and sodium hydrogen sulfate.

Other suitable builders are polymeric polycarboxylates, i.e., for example, the alkali metal salts of polyacrylic or polymethacrylic acid, for example, those with a relative molecular weight of 500 to 70,000 g/mol.

The molecular weights mentioned in this specification for polymeric polycarboxylates are weight-average molecular weights $M_W$ of the particular acid form which, fundamentally, were determined by gel permeation chromatography (GPC), equipped with a UV detector.

The measurement was carried out against an external polyacrylic acid standard, which provides realistic molecular weight values by virtue of its structural similarity to the polymers investigated. These values differ significantly from the molecular weights measured against polystyrene sulfonic acids as standard. The molecular weights measured against polystyrene sulfonic acids are generally significantly higher than the molecular weights mentioned in this specification.

Particularly suitable polymers are polyacrylates, which preferably have a molecular weight of 2,000 to 20,000 g/mol. By virtue of their superior solubility, preferred representatives of this group are again the short-chain polyacrylates, which have molecular weights of 2,000 to 10,000 g/mol and, more particularly, 3,000 to 5,000 g/mol.

Suitable polymers can also include substances that consist partially or totally of vinyl alcohol units or its derivatives.

Further suitable copolymeric polycarboxylates are particularly those of acrylic acid with methacrylic acid and of acrylic acid or methacrylic acid with maleic acid. Copolymers of acrylic acid with maleic acid, which comprise 50 to 90 wt. % acrylic acid and 50 to 10 wt. % maleic acid, have proven to be particularly suitable. Their relative molecular weight, based on free acids, generally ranges from 2,000 to 70,000 g/mol, preferably 20,000 to 50,000 g/mol and especially 30,000 to 40,000 g/mol. The (co)polymeric polycarboxylates can be added either as an aqueous solution or preferably as powder.

In order to improve the water solubility, the polymers can also comprise allylsulfonic acids as monomers, such as for example, allyloxybenzene sulfonic acid and methallyl sulfonic acid as in the EP-B-0 727 448.

Biodegradable polymers comprising more than two different monomer units are particularly preferred, examples being those comprising, as monomers, salts of acrylic acid and of maleic acid, and also vinyl alcohol or vinyl alcohol derivatives, as in DE-A-43 00 772, or those comprising, as monomers, salts of acrylic acid and of 2-alkylallyl sulfonic acid as in DE-C-42 21 381, and also sugar derivatives.

Further preferred copolymers are those that are described in German Patent Applications DE-A-43 03 320 and DE-A-44 17 734 and preferably include acrolein and acrylic acid/acrylic acid salts or acrolein and vinyl acetate as monomers.

Similarly, other preferred builders are polymeric aminodicarboxylic acids, salts or precursors thereof. Those polyaspartic acids or their salts and derivatives disclosed in German Patent Application DE-A 195 40 086 as having a bleach-stabilizing action in addition to cobuilder properties, are particularly preferred.

Further suitable builders are polyacetals that can be obtained by treating dialdehydes with polyol carboxylic acids that possess 5 to 7 carbon atoms and at least 3 hydroxyl groups, as described in European Patent Application EP-A-0 280 223. Preferred polyacetals are obtained from dialdehydes like glyoxal, glutaraldehyde, terephthalaldehyde as well as their mixtures and from polycarboxylic acids like gluconic acid and/or glucoheptonic acid.

Further suitable organic builders are dextrins, for example, oligomers or polymers of carbohydrates that can be obtained by the partial hydrolysis of starches. The hydrolysis can be carried out using typical processes, for example, acidic or enzymatic catalyzed processes. The hydrolysis products preferably have average molecular weights in the range 400 to 500 000 g/mol. A polysaccharide with a dextrose equivalent (DE) of 0.5 to 40 and, more particularly, 2 to 30 is preferred, the DE being an accepted measure of the reducing effect of a polysaccharide in comparison with dextrose, which has a DE of 100. Both maltodextrins with a DE between 3 and 20 and dry glucose syrups with a DE between 20 and 37 and also so-called yellow dextrins and white dextrins with relatively high molecular weights of 2,000 to 30,000 g/mol may be used. A preferred dextrin is described in British Patent Application 94 19 091.

The oxidized derivatives of such dextrins concern their reaction products with oxidizing agents that are capable of oxidizing at least one alcohol function of the saccharide ring to the carboxylic acid function. Such oxidized dextrins and processes for their manufacture are known, for example, from European Patent Applications EP-A-0 232 202, EP-A 0 427 349, EP-A 0 472 042 and EP-A 0 542 496 as well as from International Patent Applications WO-A-92/18542, WO-A-93/08251, WO-A-93/16110, WO-A-94/28030, WO-A-95/07303, WO-A-95/12619 and WO-A-95/20608. An oxidized oligosaccharide according to German Patent Application DE-A 196 00 018 is also suitable. A product oxidized at $C_6$ of the saccharide ring can be particularly advantageous.

Oxydisuccinates and other derivatives of disuccinates, preferably ethylenediamine disuccinate are also further suitable cobuilders. Here, ethylenediamine-N,N'-disuccinate (EDDS), the synthesis of which is described, for example, in U.S. Pat. No. 3,158,615, is preferably used in the form of its sodium or magnesium salts. In this context, glycerine disuccinates and glycerine trisuccinates are also particularly preferred, such as those described in the U.S. Pat. Nos. 4,524,009, 4,639,325, in European Patent Application EP-A 0 150 930 and in Japanese Patent Application JP-A-93/339 896. Suitable addition quantities in zeolite-containing and/or silicate-containing formulations range from 3 to 15% by weight %.

Other useful organic co-builders are, for example, acetylated hydroxycarboxylic acids and salts thereof which optionally may also be present in lactone form and which contain at least 4 carbon atoms, at least one hydroxyl group and at most two acid groups. Such cobuilders are described, for example, in International Patent Application WO 95/20029.

In addition, the compositions can also comprise components that positively influence the oil and fat removal from textiles during the wash (so-called soil repellents). This effect is particularly noticeable when a textile is dirty and had been previously already washed several times with an inventive detergent that comprised this oil- or fat-removing component. The preferred oil and fat removing components include, for example, nonionic cellulose ethers such as methyl cellulose and methyl hydroxypropyl cellulose with a content of methoxy groups of 15 to 30 wt. % and hydroxypropoxy groups of 1 to 15 wt. %, each based on the nonionic cellulose ether, as well as polymers of phthalic acid and/or terephthalic acid or their derivatives known from the prior art, particularly polymers of ethylene terephthalates and/or polyethylene glycol terephthalates or anionically and/or nonionically modified derivatives thereof. From these, the sulfonated derivatives of the phthalic acid polymers and the terephthalic acid polymers are particularly preferred.

Further suitable ingredients of the composition are water-soluble inorganic salts such as bicarbonates, carbonates, amorphous silicates or mixtures of these; alkali carbonate and amorphous silicate are particularly used, principally sodium silicate with a molar ratio $Na_2O:SiO_2$ of 1:1 to 1:4.5, preferably of 1:2 to 1:3.5.

Preferred compositions comprise alkaline salts, builders and/or cobuilders, preferably sodium carbonate, zeolite, crystalline, layered sodium silicates and/or trisodium citrate, in amounts of 0.5 to, 70 wt. %, preferably 0.5 to 50 wt. %, particularly 0.5 to 30 wt. % anhydrous substance.

When used in automatic washing processes, it can be advantageous to add conventional foam inhibitors to the compositions. Suitable foam inhibitors include for example, soaps of natural or synthetic origin, which have a high content of $C_{18}$-$C_{24}$ fatty acids. Suitable non-surface-active types of foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example, mixtures of silicones, paraffins or waxes, are also used with advantage. Preferably, the foam inhibitors, especially silicone-containing and/or paraffin-containing foam inhibitors, are loaded onto a granular, water-soluble or dispersible carrier material. Especially in this case, mixtures of paraffins and bis stearylethylene diamides are preferred.

The salts of polyphosphonic acid can be considered as sequestrants or as stabilizers, particularly for peroxy compounds and enzymes, which are sensitive towards heavy metal ions. Here, the sodium salts of, for example, 1-hydroxyethane-1,1-diphosphonate, diethylenetriamine pentamethylene phosphonate or ethylenediamine tetramethylene phosphonate are used in amounts of 0.1 to 5 wt. %.

Graying inhibitors have the function of maintaining the dirt that was removed from the fibers suspended in the washing liquor, thereby preventing the dirt from resettling. Water-soluble colloids of mostly organic nature are suitable for this, for example, the water-soluble salts of (co)polymeric carboxylic acids, glue, gelatins, salts of ether carboxylic acids or ether sulfonic acids of starches or celluloses, or salts of acidic sulfuric acid esters of celluloses or starches. Water-soluble, acid group-containing polyamides are also suitable for this purpose. Moreover, soluble starch preparations and others can be used as the above-mentioned starch products, e.g., degraded starches, aldehyde starches etc. Polyvinyl pyrrolidone can also be used. Preference, however, is given to the use of cellulose ethers such as carboxymethyl cellulose (Na salt), methyl cellulose, hydroxyalkyl celluloses and mixed ethers such as methyl hydroxyethyl cellulose, methyl hydroxypropyl cellulose, methyl carboxymethyl cellulose and mixtures thereof, as well as polyvinyl pyrrolidone, which can be added, for example, in amounts of 0.1 to 5 wt. %, based on the composition.

The compositions may comprise e.g., derivatives of diaminostilbene disulfonic acid or alkali metal salts thereof as the optical brighteners. Suitable optical brighteners are, for example, salts of 4,4'-bis-(2-anilino-4-morpholino-1,3,5-triazinyl-6-amino)stilbene-2,2'-disulfonic acid or compounds of similar structure which contain a diethanolamino group, a methylamino group, an anilino group or a 2-methoxyethylamino group instead of the morpholino group. Brighteners of the substituted diphenylstyryl type may also be present, for example, the alkali metal salts of 4,4'-bis(2-sulfostyryl)diphenyl, 4,4'-bis(4-chloro-3-sulfostyryl)diphenyl or 4-(4-chlorostyryl)-4'-(2-sulfostyryl)diphenyl. Mixtures of the mentioned brighteners may also be used.

In addition, UV absorbers may also be added. These are compounds with distinct absorption abilities for ultra violet radiation, which contribute as UV stabilizers as well as to improve the light stability of colorants and pigments both for textile fibers as well as for the skin of the wearer of textile products by protecting against the UV radiation that penetrates the fabric. In general, the efficient radiationless deactivating compounds are derivatives of benzophenone, substituted with hydroxyl and/or alkoxy groups, mostly in position(s) 2-and/or 4. Also suitable are substituted benzotriazoles, additionally acrylates that are phenyl-substituted in position 3 (cinnamic acid derivatives), optionally with cyano groups in position 2, salicylates, organic Ni complexes, as well as natural substances such as umbelliferone and the endogenous urocanic acid. In a preferred embodiment, the UV absorbers absorb UV-A and UV-B radiation as well as possible UV-C radiation and re-emit light with blue wavelengths, such that they additionally have an optical brightening effect. Preferred UV absorbers are also those UV-absorbers disclosed in European Patent Applications EP-A-0 374 751, EP-A-0 659 877, EP-A-0 682 145, EP-A-0 728 749 and EP-A-0 825 188 such as triazine derivatives, e.g., hydroxyaryl-1,3,5-triazine, sulfonated 1,3,5-triazine, O-hydroxyphenylbenzotriazole and 2-aryl-2H-benzotriazole as well as bis(anilinotriazinylamino)stilbene disulfonic acid and their derivatives. Ultra violet absorbing pigments like titanium dioxide can also be used as UV absorbers.

The compositions can also comprise common thickeners and anti-deposition agents as well as viscosity regulators such as polyacrylates, polycarboxylic acids, polysaccharides and their derivatives, polyurethanes, polyvinyl pyrrolidones, castor oil derivatives, polyamine derivatives such as quaternized and/or ethoxylated hexamethylenediamines as well as any mixtures thereof. Preferred compositions have a viscosity below 10,000 mPa s, measured with a Brookfield viscosimeter at a temperature of 20° C. and a shear rate of 50 $min^{-1}$.

The compositions can comprise further typical detergent and cleansing agent ingredients such as perfumes and/or colorants, wherein such colorants are preferred that leave no or negligible coloration on the fabrics being washed. Preferred amounts of the totality of the added colorants are below 1 wt. %, preferably below 0.1 wt. %, based on the composition. The compositions can also comprise white pigments such as e.g., $TiO_2$.

The densities of the preferred compositions are 0.5 to 2.0 $g/cm^3$, particularly 0.7 to 1.5 $g/cm^3$. The density difference between the encapsulated peroxycarboxylic acid particles and the liquid phase of the composition is preferably not more than 10% of the density of one or both and is particularly so small that the encapsulated peroxycarboxylic acid particles and preferably the various solid particles optionally comprised in the compositions float in the liquid phase; this can be facilitated by the optional use of one of the above-mentioned thickeners.

EXAMPLES

Example 1

Net weights:

40.0 g ε-Phthalimidoperoxyhexanoic acid, hereinafter "PAP" (Eureco L, 30% concentration in water)

30.0 g Polyvinyl alcohol (Mowiol 4-88, 10% conc.)

30.0 g demineralized water 0.1 g hydrochloric acid (10% conc.)

30 g of a 10% concentration Mowiol solution (Type 4-88) were diluted with a further 30 g of demineralized water. 40 g PAP were added with stirring, and the pH of the resulting homogeneous dispersion was adjusted to a pH of 3.5 with 10% concentration hydrochloric acid.

This dispersion was dried with stirring in a Büchi spray dryer (type 190). A fine white powder was obtained with a spray flow of 700 liters/hour, a throughput of step 6, an aspirator power of step 20 and entry- and exit temperatures of 101° C. and 57° C. respectively. The yield was 13.2 g, corresponding to 88% of the theory. The particle size of the product was between 5 and 30 μm, with few agglomerates. The residual moisture was less than 4%.

The exact active content of the powder was determined by elemental analysis (nitrogen value) and was 69%.

The quality of the product was determined after various times from the active oxygen content ("AO" by titration). After 2 days, the active oxygen loss was 17%.

Example 2

Net weights:

33.3 g ε-Phthalimidoperoxyhexanoic acid, hereinafter "PAP" (Eureco L)

50.0 g Polyvinyl alcohol (Mowiol 4-88, 10% conc.)

30.0 g demineralized water 0.1 g hydrochloric acid (10% conc.)

50 g of a 10% conc. Mowiol solution (Type 4-88) were diluted with a further 30 g of demineralized water. 33.3 g PAP were added with stirring, and the pH of the resulting homogeneous dispersion was adjusted to a pH of 3.5 with 10% concentration hydrochloric acid.

This dispersion was dried with stirring in a Büchi spray dryer (type 190). A fine white powder was obtained with a spray flow of 700 liters/hour, a throughput of step 6, an aspirator power of step 20 and entry- and exit temperatures of 101° C. and 57° C. respectively. The yield was 12.8 g, corresponding to 85% of the theory.

The exact active content of the powder was determined by elemental analysis (nitrogen value) and was 55%.

The quality of the product was determined after various times from the active oxygen content ("AO" by titration). After 2 days, the active oxygen loss was 14%.

Example 3

Net weights:

40.0 g ϵ-Phthalimidoperoxyhexanoic acid, hereinafter "PAP" (Eureco L)

30.0 g Polyvinyl alcohol (Mowiol 3-83, 10% conc.)

30.0 g demineralized water 0.1 g hydrochloric acid (10% conc.)

30 g of a 10% concentration Mowiol solution (Type 3-83) were diluted with a further 30 g of demineralized water. 40 g PAP were added with stirring, and the pH of the resulting homogeneous dispersion was adjusted to a pH of 3.5 with 10% concentration hydrochloric acid.

This dispersion was dried with stirring in a Büchi spray dryer (type 190). A fine white powder was obtained with a spray flow of 700 liters/hour, a throughput of step 6, an aspirator power of step 20 and entry- and exit temperatures of 107° C. and 53° C. respectively. The yield was 8.3 g corresponding to 55% of the theory.

The exact active content of the powder was determined by elemental analysis (nitrogen value) and was 70%.

The quality of the product was determined after various times from the active oxygen content ("AO" by titration). After 2 days, the active oxygen loss was 19%.

Example 4

Net weights:

33.3 g ϵ-Phthalimidoperoxyhexanoic acid, hereinafter "PAP" (Eureco L)

50.0 g Polyvinyl alcohol (Mowiol 3-83, 10% conc.)

30.0 g demineralized water 0.1 g hydrochloric acid (10% conc.)

50 g of a 10% concentration Mowiol solution (Type 3-83) were diluted with a further 30 g of demineralized water. 33.3 g PAP were added with stirring, and the pH of the resulting homogeneous dispersion was adjusted to a pH of 3.5 with 10% concentration hydrochloric acid.

This dispersion was dried with stirring in a Büchi spray dryer (type 190). A fine white powder was obtained with a spray flow of 700 liters/hour, a throughput of step 6, an aspirator power of step 20 and entry- and exit temperatures of 100° C. and 60° C. respectively. The yield was 4.6 g corresponding to 31% of the theory.

The exact active content of the powder was determined by elemental analysis (nitrogen value) and was 55%.

The quality of the product was determined after various times from the active oxygen content ("AO" by titration). After 2 days, the active oxygen loss was 15%.

Example 5

Net weights:

40.0 g ϵ-Phthalimidoperoxyhexanoic acid, hereinafter "PAP" (Eureco L, 30% conc.)

30.0 g polyvinyl alcohol (Mowiol 4-88, 10% conc.)

30.0 g demineralized water 0.1 g hydrochloric acid (10% conc.)

30 g of a 10% concentration Mowiol solution (Type 4-88) were diluted with a further 30 g of demineralized water. 40% PAP were added with stirring, and the pH of the resulting homogeneous dispersion was adjusted to a pH of 3.5 with 10% concentration hydrochloric acid.

This dispersion was dried with stirring in a Büchi spray dryer (type 190). A fine white powder was obtained with a spray flow of 800 liters/hour, a throughput of step 8, an aspirator power of step 20 and entry- and exit temperatures of 86° C. and 45° C. respectively. The yield was 7.0 g corresponding to 47% of the theory.

The particle size of the product was between 20 and 150 μm, with agglomerates. The residual moisture was 1.3%.

The exact active content of the powder was determined by elemental analysis (nitrogen value) and was 86%.

The quality of the product was determined after various times from the active oxygen content ("AO" by titration). After 2 days, the active oxygen loss was 12% and after 42 days 15%.

Example 6

Net weights:

40.0 g ϵ-Phthalimidoperoxyhexanoic acid, hereinafter "PAP" (Eureco L, 30% conc.)

30.0 g polyvinyl alcohol (Mowiol 4-88, 10% conc.)

30.0 g demineralized water 0.1 g hydrochloric acid (10% conc.)

30 g of a 10% concentration Mowiol solution (Type 4-88) were diluted with a further 30 g of demineralized water. 40% PAP were added with stirring, and the pH of the resulting homogeneous dispersion was adjusted to a pH of 3.5 with 10% concentration hydrochloric acid.

This dispersion was dried with stirring in a Büchi spray dryer (type 190). A fine white powder was obtained with a spray flow of 800 liters/hour, a throughput of step 8, an aspirator power of step 20 and entry- and exit temperatures of 86° C. and 45° C. respectively. The yield was 4.1 g corresponding to 27% of the theory.

The particle size of the product was between 5 and 25 μm, with agglomerates. The residual moisture was 2.5%.

The exact active content of the powder was determined by elemental analysis (nitrogen value) and was 86%.

The quality of the product was determined after various times from the active oxygen content ("AO" by titration). After 2 days, the active oxygen loss was 6% and after 42 days 17%.

Example 7

Net weights:

16.0 g ϵ-Phthalimidoperoxyhexanoic acid, hereinafter "PAP" (Eureco L, 30% conc.)

12.0 g polyvinyl alcohol (Mowiol 4-88, 10% conc.)

12.0 g demineralized water 12.0 g polyacrylic acid, sodium salt ($M_w$ 2100, 10% conc., adjusted to pH 3.5 with 10% concentration hydrochloric acid)

12 g of a 10% concentration Mowiol solution (Type 4-88) were diluted with a further 12 g of demineralized water. 12 g Polyacrylic acid and 16 g PAP were added with stirring and the pH of the resulting homogeneous dispersion was 3.5.

This dispersion was dried with stirring in a Büchi spray dryer (type 190). A fine white powder was obtained with a spray flow of 800 liters/hour, a throughput of step 7, an aspirator power of step 20 and entry- and exit temperatures of 91° C. and 51° C. respectively.

The yield was 2.7 g corresponding to 38% of the theory.

The particle size of the product was between 2 and 25 μm, with agglomerates.

The exact active content of the powder was determined by elemental analysis (nitrogen value) and was 55%.

The quality of the product was determined after various times from the active oxygen content ("AO" by titration). After 2 days, the active oxygen loss was 21% and after 42 days 60%.

Example 8

Net weights:

16.0 g ϵ-Phthalimidoperoxyhexanoic acid, hereinafter "PAP" (Eureco L, 30% conc., unstabilized)

12.0 g Polyvinyl alcohol (Mowiol 4-88, 10% conc.)

12.0 g demineralized water 12.0 g citric acid (10% conc.)

12 g of a 10% concentration Mowiol solution (Type 4-88) were diluted with a further 12 g of demineralized water. 12 g of a 10% citric acid solution and 16 g PAP were added with stirring and the pH of the resulting homogeneous dispersion was 2.0.

This dispersion was dried with stirring in a Büchi spray dryer (type 190). A fine white powder was obtained with a spray flow of 800 liters/hour, a throughput of step 7, an aspirator power of step 20 and entry- and exit temperatures of 89° C. and 47° C. respectively.

The yield was 2.0 g corresponding to 28% of the theory.

The particle size of the product was between 2 and 30 μm, with agglomerates. The residual moisture was 2.5%.

The exact active content of the powder was determined by elemental analysis (nitrogen value) and was 58%.

The quality of the product was determined after various times from the active oxygen content ("AO" by titration). After 2 days, the active oxygen loss was 18% and after 42 days 21%.

The invention clamed is:

1. An encapsulated bleaching agent particle consisting of:

A) a core; and

B) a water-soluble coating material that surrounds this core, wherein the core comprises:

a) phthalimidoperoxyhexanoic acid in particulate form in an amount of 20 wt. % to 90 wt. % of the encapsulated particle; and b) polyvinyl alcohol, and wherein the coating material comprises:

c) polyvinyl alcohol; and d) a mineral acid, wherein the bleaching agent particle is a solid particle.

2. The particle according to claim 1, wherein the proportion by weight of polyvinyl alcohol to acid in the coating material is in a ratio of 1,000:1 to 1:2.

3. The particle according to claim 1, wherein the core further comprises carrier material in addition to the phthalimidoperoxyhexanoic acid, said carrier material being identical to the coating material.

4. The particle according to claim 1, wherein coating material comprises 5 wt. % to 50 wt. % of the encapsulated particle.

5. The particle according to claim 1, wherein the content of phthalimidoperoxyhexanoic acid is 20 wt.% to 50 wt. %.

6. The particle according to claim 1, wherein the phthalimidoperoxyhexanoic acid is 6-phthalimidoperoxyhexanoic acid.

7. The particle according to claim 6, wherein the phthalimidoperoxyhexanoic acid is ϵ-phthalimidoperoxyhexanoic acid.

8. A detergent or cleansing agent comprising bleaching agent particles according to claim 1.

* * * * *